US012319992B2

(12) United States Patent
Winkelhofer et al.

(10) Patent No.: US 12,319,992 B2
(45) Date of Patent: Jun. 3, 2025

(54) COLD ROLLED STEEL SHEET

(71) Applicant: VOESTALPINE STAHL GMBH, Linz (AT)

(72) Inventors: Florian Winkelhofer, Kirchberg-Thening (AT); Thomas Hebesberger, Pasching (AT); Martin Gruber, Pregarten (AT); Johannes Rehrl, St. Marien (AT)

(73) Assignee: VOESTALPINE STAHL GMBH, Linz (AT)

( * ) Notice: Subject to any disclaimer, the term of this patent is extended or adjusted under 35 U.S.C. 154(b) by 841 days.

(21) Appl. No.: 17/423,742

(22) PCT Filed: Nov. 28, 2019

(86) PCT No.: PCT/EP2019/082855

§ 371 (c)(1),
(2) Date: Jul. 16, 2021

(87) PCT Pub. No.: WO2020/151855

PCT Pub. Date: Jul. 30, 2020

(65) Prior Publication Data

US 2022/0112586 A1 Apr. 14, 2022

(30) Foreign Application Priority Data

Jan. 22, 2019 (SE) ..... 1950072-7

(51) Int. Cl.

| | |
|---|---|
| ***C22C 38/58*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.

CPC ..... *C22C 38/58* (2013.01); *C21D 8/0205* (2013.01); *C21D 8/0236* (2013.01); *C22C 38/002* (2013.01); *C22C 38/008* (2013.01); *C22C 38/02* (2013.01); *C22C 38/06* (2013.01); *C22C 38/42* (2013.01); *C22C 38/46* (2013.01); *C22C 38/48* (2013.01); *C22C 38/50* (2013.01); *C22C 38/54* (2013.01); *C21D 2211/001* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

2015/0167133 A1* 6/2015 Paul ..... C22C 38/20 148/330

FOREIGN PATENT DOCUMENTS

| | | | |
|---|---|---|---|
| CN | 104245971 | A | 12/2014 |
| EP | 2327810 | A1 | 6/2011 |
| EP | 2831296 | A1 | 2/2015 |
| EP | 3187613 | A1 | 7/2017 |
| SE | 1551681 | A1 | 6/2017 |
| WO | 2013144376 | A1 | 10/2013 |
| WO | 2013144377 | A1 | 10/2013 |
| WO | 2017108251 | A1 | 6/2017 |
| WO | 2018096090 | A1 | 5/2018 |

OTHER PUBLICATIONS

Chinese Office Action dated Jul. 1, 2022, for Chinese Patent Application No. 201980089528.1.
International Search Report and Written Opinion dated Feb. 6, 2020, for International Patent Application No. PCT/EP2019/082855.
Chinese Office Action dated Nov. 24, 2023, for Chinese Patent Application No. 201980089528.1.
Research on Hydrogen Induced Delayed Fracture of Chinese Automotive EVI and High Strength Steel, CITIC Microalloying Technology, China Automotive Engineering Research Institute Co., Ltd., pp. 164 165, Beijing Institute of Technology Press, Jan. 2018, 1st edition.
European Office Action dated Sep. 2, 2024, for European Patent Application No. 19817976.4.

* cited by examiner

*Primary Examiner* — Anthony M Liang
(74) *Attorney, Agent, or Firm* — KARCESKI IP LAW, PLLC

(57) ABSTRACT

The invention relates to a cold rolled steel sheet having a composition consisting of (in wt. %): C 0.15-0.25; Si 0.5-1.6; Mn 2.2-2.8; Cr≤0.8; Mo≤0.2; Al 0.03-1.0; Nb≤0.04; V≤0.04; Ti 0.02-0.04; B 0.001-0.005; balance Fe apart from impurities, wherein the impurity contents of Cu and Ni are limited to ≤0.15, the cold rolled steel has a multiphase microstructure comprising a matrix of bainitic ferrite and ≤10 vol. % polygonal ferrite and the tensile strength ($R_m$) is 980-1500 MPa.

7 Claims, No Drawings

COLD ROLLED STEEL SHEET

CROSS-REFERENCE TO RELATED APPLICATION(S)

This is a National Stage Entry into the United States Patent and Trademark Office from International Patent Application No. PCT/EP2019/082855, filed on Nov. 28, 2019, which claims priority to Swedish Patent Application No. SE 1950072-7, filed on Jan. 22, 2019, the entire contents of both of which are incorporated herein by reference.

FIELD OF THE INVENTION

The present invention relates to high strength steel sheets suitable for applications in automobiles. In particular, the invention relates to high ductility high strength cold rolled steel sheets having a tensile strength of at least 980 MPa and an excellent formability.

BACKGROUND OF THE INVENTION

For a great variety of applications increased strength levels are a pre-requisite for light-weight constructions in particular in the automotive industry, since car body mass reduction results in reduced fuel consumption.

Automotive body parts are often stamped out of sheet steels, forming complex structural members of thin sheet. However, such parts cannot be produced from conventional high strength steels, because of a too low formability of the complex structural parts. For this reason, multi-phase Transformation Induced Plasticity aided steels (TRIP steels) have gained considerable interest in the last years, in particular for use in auto body structural parts and as seat frame materials.

TRIP steels possess a multi-phase microstructure, which includes a meta-stable retained austenite phase, which is capable of producing the TRIP effect. When the steel is deformed, the austenite transforms into martensite, which results in remarkable work hardening. This hardening effect acts to resist necking in the material and postpone failure in sheet forming operations. The microstructure of a TRIP steel can greatly alter its mechanical properties. The most important aspects of the TRIP steel microstructure are the volume percentage, size and morphology of the retained austenite phase, as these properties directly affect the austenite to martensite transformation, when the steel is deformed. There are several ways by which it is possible to chemically stabilize austenite at room temperature. In low alloy TRIP steels the austenite is stabilized through its carbon content and the small size of the austenite grains. The carbon content necessary to stabilize austenite is approximately 1 wt. %. However, high carbon content in steel cannot be used in many applications because of impaired weldability.

Specific processing routs are therefore required to concentrate the carbon into the austenite in order to stabilize it at room temperature. A common TRIP steel chemistry also contains small additions of other elements to help stabilizing the austenite as well as aiding the creation of microstructures which partition carbon into the austenite. In order to inhibit the austenite to decompose during the bainite transformation it has generally been considered necessary to add relatively high amounts of manganese and silicon.

TRIP-aided steel with a Bainitic Ferrite matrix (TBF)-steels have been known for long and attracted a lot of interest, mainly because the bainitic ferrite matrix allows an excellent stretch flangability. Moreover, the TRIP effect ensured by the strain-induced transformation of metastable retained austenite islands into martensite, remarkably improves their drawability.

WO2013/144377 discloses a cold rolled TBF-steel sheet alloyed with Si and Al and having a tensile strength of at least 980 MPa. WO2013/144376 discloses a cold rolled TBF-steel sheet alloyed with Si and Cr and having a tensile strength of at least 980 MPa. WO2017/108251 discloses a cold rolled galvannealed steel sheet alloyed with Si and Cr and having a tensile strength of at least 1180 MPa. WO2018096090 discloses a cold rolled steel sheet alloyed with Si and Cr and having a matrix of bainitic ferrite and a tensile strength in the range of 980-1100 MPa.

Although these steels disclose several attractive properties there is demand for 980 MPa steel sheets having an improved property profile with respect to advanced forming operations, where both local elongation and total elongation is of importance such as for structural members in automobile seats.

SUMMARY OF THE INVENTION

The present invention is directed to high strength (TBF) steel sheets having a tensile strength of 980-1500 MPa and an excellent formability, wherein it should be possible to produce the steel sheets on an industrial scale in a Continuous Annealing Line (CAL). The invention aims at providing a steel composition that can be processed to complicated structural members, where both local elongation and total elongation is of importance, in particular for automobile seat components. However, it is generally considered that if the total elongation is increased, then the properties governed by the local elongation such as the hole expanding ratio (HER) or (λ) is deteriorated.

DETAILED DESCRIPTION OF EMBODIMENT(S) OF THE INVENTION

The invention is described in the claims.

The steel sheet has a composition consisting of the following alloying elements (in wt. %):

| | |
|---|---|
| C | 0.15-0.25 |
| Si | 0.5-1.6 |
| Mn | 2.2-2.8 |
| Cr | ≤0.8 |
| Mo | ≤0.2 |
| Al | 0.03-1.0 |
| Nb | ≤0.04 |
| V | ≤0.04 |
| Ti | 0.02-0.04 |
| B | 0.001-0.005 |
| Ti/B | 5-30 |
| Cu | ≤0.15 |
| Ni | ≤0.15 |

balance Fe apart from impurities, the balance consists of iron and impurities.

The importance of the separate elements and their interaction with each other as well as the limitations of the chemical ingredients of the claimed alloy are briefly explained in the following. All percentages for the chemical composition of the steel are given in weight % (wt. %) throughout the description. Upper and lower limits of the individual elements can be freely combined within the limits set out in the claims. The arithmetic precision of the numerical values can be increased by one or two digits for all values given in the present application. Hence, a value of given as e.g. 0.1% can also be expressed as 0.10 or 0.100%. The amounts of the microstructural constituents are given in volume % (vol. %).

C: 0.15-0.25%

C stabilizes the austenite and is important for obtaining sufficient carbon within the retained austenite phase. C is also important for obtaining the desired strength level. Generally, an increase of the tensile strength in the order of 100 MPa per 0.1% C can be expected. When C is lower than 0.15% then it is difficult to attain a tensile strength of 980 MPa. If C exceeds 0.25%, then the weldability is impaired. The upper limit may thus be 0.24, 0.23 or 0.22%. The lower limit may be 0.16, 0.17, 0.18, 0.19, or 0.20%.

Si: 0.5-1.6%

Si acts as a solid solution strengthening element and is important for securing the strength of the thin steel sheet. Si suppresses the cementite precipitation and is essential for austenite stabilization.

However, if the content is too high, then too much silicon oxides will form on the strip surface, which may lead to cladding on the rolls in the CAL and, as a result thereof, to surface defects on subsequently produced steel sheets. The upper limit is therefore 1.6% and may be restricted to 1.55, 1.5, 1.45, 1.40, 1.35, 1.3, 1.25 or 1.2%. The lower limit is 0.5% and may be set to 0.55, 0.60, 0.65, 0.70, 0.75 or 0.80%.

Mn: 2.2-2.8%

Manganese is a solid solution strengthening element, which stabilises the austenite by lowering the Ms temperature and prevents ferrite and pearlite to be formed during cooling. In addition, Mn lowers the $A_{c3}$ temperature and is important for the austenite stability. At a content of less than 2.2% it might be difficult to obtain the desired amount of retained austenite, a tensile strength of 980 MPa and the austenitizing temperature might be too high for conventional industrial annealing lines. In addition, at lower contents it may be difficult to avoid the formation of polygonal ferrite. However, if the amount of Mn is higher than 2.8%, problems with segregation may occur because Mn accumulates in the liquid phase and causes banding, resulting in a potentially deteriorated workability. The upper limit may therefore be 2.7, 2.6, 2.5 or 2.4%. The lower limit may be 2.3 or 2.4%.

Cr: ≤0.8%

Cr is effective in increasing the strength of the steel sheet. Cr is an element that forms ferrite and retards the formation of pearlite and bainite. The $A_{c3}$ temperature and the Ms temperature are only slightly lowered with increasing Cr content. Cr results in an increased amount of stabilized retained austenite. The amount of Cr is limited to 0.8%. The upper limit may be 0.75, 0.70, 0.65, 0.60, 0.55, 0.50, 0.45 or 0.40, 0.35, 0.30 or 0.25%. The lower limit may be 0.01, 0.02, 0.03, 0.04, 0.05, 0.06, 0.07, 0.08, 0.09, 0.10, 0.11, 0.12, 0.13, 0.14, 0.15, 0.20 or 0.25%.

Al: 0.01-1.0%

Al promotes ferrite formation and is also commonly used as a deoxidizer. Al, like Si, is not soluble in the cementite and therefore it considerably delays the cementite formation during bainite formation. Additions of Al result in a remarkable increase in the carbon content in the retained austenite. However, the Ms temperature is also increased with increasing Al content. A further drawback of Al is that it results in a drastic increase in the $A_{c3}$ temperature. However, a main disadvantage of Al is its segregation behavior during casting. During casting Mn is enriched in the middle of the slabs and the Al-content is decreased. Therefore, in the middle of the slab a significant austenite stabilized region or band may be formed. This results at the end of the processing in martensite banding and that low strain internal cracks are formed in the martensite band. On the other hand, Si and Cr are also enriched during casting. Hence, the propensity for martensite banding may be reduced by alloying with Si and Cr, since the austenite stabilization due to the Mn enrichment is counteracted by these elements. For these reasons the Al content is preferably limited. The upper level may be 0.9, 0.8, 0.7, 0.6, 0.5, 0.4, 0.3, 0.2 or 0.1%. The lower limit may be set to 0.02, 0.03, 0.04, 0.05, 0.06, 0.07, 0.08, 0.09 or 0.1%. If Al is used for deoxidation only then the upper level may then be 0.09, 0.08, 0.07 or 0.06%. For securing a certain effect the lower level may set to 0.03 or 0.04%.

Nb: ≤0.04%

Nb is commonly used in low alloyed steels for improving strength and toughness, because of its influence on the grain size. Nb increases the strength elongation balance by refining the matrix microstructure and the retained austenite phase due to precipitation of NbC. The steel may contain Nb in an amount of ≤0.04%, preferably ≤0.03%. A deliberate addition of Nb is not necessary according to the present invention. The upper limit may therefore be restricted to ≤0.01%.

V: ≤0.04%

The function of V is similar to that of Nb in that it contributes to precipitation hardening and grain refinement. The steel may contain V in an amount of ≤0.04%, preferably ≤0.03%. A deliberate addition of V is not necessary according to the present invention. The upper limit may therefore be restricted to ≤0.01%.

Ti: 0.02-0.04%

Ti is commonly used in low alloyed steels for improving strength and toughness, because of its influence on the grain size by forming carbides, nitrides or carbonitrides. In particular, Ti is a strong nitride former and can be used to bind the nitrogen in the steel. However, the effect tends to be saturated above 0.04%. In order to having a good fixation of N to Ti the lower amount should be 0.02%.

B: 0.001-0.005%

B suppresses the formation of ferrite and improves the weldability of the steel sheet. In order to have a noticeable effect at least 0.001% should be added. However, excessive amounts of deteriorate the workability. The upper limit is therefore 0.005%. A preferred range is 0.002-0.004%.

Cu: ≤0.15%

Cu is an undesired impurity element that is restricted to ≤0.15% by careful selection of the scrap used. The upper limit may be restricted to 0.12, 0.10, 0.08 or 0.06%.

Ni: ≤0.15%

Ni is also an undesired impurity element that is restricted to ≤0.15% by careful selection of the scrap used. The upper limit may be restricted to 0.12, 0.10, 0.08 or 0.06%.

Other impurity elements may be comprised in the steel in normal occurring amounts. However, it is preferred to limit the amounts of P, S and N to the following optional maximum contents:

P: ≤0.02%

S: ≤0.005%

N: ≤0.03, ≤0.01, ≤0.007, ≤0.006 or ≤0.03, ≤0.006 or ≤0.005

It is preferred to control the nitrogen content to the range of 0.002-0.006%, preferably to 0.003-0.005% if a stable fixation of nitrogen is desired.

Ti/B: 5-30

The ratio TUB is preferably adjusted to be in the range of 5-30 in order to secure an optimal fixation of the nitrogen in the steel, resulting in free unbounded boron in the steel. Preferably, such ratio can be adjusted to be in the range of 8-11.

The cold rolled steel sheets of the present invention have a microstructure mainly consisting of retained austenite embedded in a matrix of bainitic ferrite (BF), i.e. the amount of bainitic ferrite is generally ≥50%.

The microstructural constituents are in the following expressed in volume % (vol. %).

The microstructure may also contain up to 30% tempered martensite (TM) and up to 20% fresh martensite (FM). The latter may be present in the final microstructure because, depending on its stability, some austenite may transform to martensite during cooling at the end of the overaging step. The amount of FM may be limited to 15%, 10%, 8% or 5%. These un-tempered martensite particles are often in close contact with the retained austenite particles and they are therefore often referred to as martensite-austenite (MA) particles.

Retained austenite is a prerequisite for obtaining the desired TRIP effect. The amount of retained austenite should therefore be in the range of 2-20%, preferably 5-15%. The amount of retained austenite was measured by means of the saturation magnetization method described in detail in Proc. Int. Conf. on TRIP-aided high strength ferrous alloys (2002), Ghent, Belgium, p. 61-64.

Polygonal ferrite (PF) is not a desired microstructural constituent and is therefore limited to ≤10%, preferably ≤9%, ≤8%, ≤7%, ≤6%, ≤5%, ≤3% or ≤1%. Most preferably, the steel is free from PF.

The mechanical properties of the claimed steel are important and at least one of the following requirements should be fulfilled:

| | | |
|---|---|---|
| tensile strength ($R_m$) | 1100-1350 | MPa |
| yield strength ($R_{p0.2}$) | 780-1100 | MPa |
| total elongation ($A_{50}$) | ≥7, in particular ≥10% | |
| hole expansion ratio (λ) | ≥20 | % |
| yield ratio ($R_{p0.2}/R_m$) | ≥0.50, in particular ≥0.75 | |

Preferably, all these requirements are fulfilled at the same time.

The $R_m$, $R_{p0.2}$ values are derived according to the European norm EN 10002 Part 1, wherein the samples were taken in the longitudinal direction of the strip. The total elongation ($A_{50}$) is derived in accordance with the Japanese Industrial Standard JIS Z 2241: 2011, wherein the samples are taken in the transversal direction of the strip.

The mechanical properties of the steel sheets of the present invention can be largely adjusted by the alloying composition and the microstructure. The microstructure may be adjusted by the heat treatment in the CAL, in particular by the isothermal treatment temperature in the overaging step. Usually, such isothermal treatment temperature in the overaging step is at or a bit above Ms temperature (such as 50° C. to 100° C. above Ms) but it is possible to heat treat in the overaging step at Ms temperature or even up to 100° C. below Ms.

As an alternative, it is possible to use the Quench and Partitioning (Q&P) process to adjust the mechanical properties of the steel sheet. The material is then annealed and thereafter cooled to a temperature below the Ms temperature, reheated to a partitioning temperature above the Ms temperature, held at this temperature for partitioning and finally cooled to room temperature. Optionally, the material subjected to Q&P may also be subjected to a batch annealing step at a low temperature (about 200° C.) in order to fine tune the mechanical properties, in particular the yield strength and the HER.

It is also possible that the material produced via the isothermal TBF-route to be subjected to a batch annealing step at a low temperature (about 200° C.) in order to fine tune the mechanical properties, in particular the yield strength and the HER.

The invention defines a cold rolled steel sheet having a) a composition consisting of (in wt. %):

| | |
|---|---|
| C | 0.15-0.25 |
| Si | 0.5-1.6 |
| Mn | 2.2-2.8 |
| Cr | ≤0.8 |
| Mo | ≤0.2 |
| Al | 0.03-1.0 |
| Nb | ≤0.04 |
| V | ≤0.04 |
| Ti | 0.02-0.04 |
| B | 0.001-0.005 |
| Ti/B | 5-30 |

balance Fe apart from impurities, wherein the impurity contents of Cu and Ni are limited to

| | |
|---|---|
| Cu | ≤0.15 |
| Ni | ≤0.15 |

b) a multiphase microstructure comprising a matrix of bainitic ferrite and wherein the amount of polygonal ferrite is ≤10 vol. %, c) the following mechanical properties

| | | |
|---|---|---|
| a tensile strength ($R_m$) | 980-1500 | MPa |
| yield strength ($R_{p0.2}$) | 580-1200 | MPa |
| total elongation ($A_{50}$) | ≥3 | % |

The cold rolled steel sheet of the present invention may contain at least 0.01% Cr.

The cold rolled steel sheet may be provided with a Zn containing layer.

The cold rolled steel sheet preferably fulfils at least one of the of the following requirements with respect to the impurity contents (in wt. %):

| | |
|---|---|
| Cu | ≤0.10 |
| Ni | ≤0.10 |
| P | ≤0.02 |
| S | ≤0.005 |
| N | 0.002-0.006. |

The cold rolled steel sheet may have a) a composition fulfilling at least one of the following requirements with respect to the impurity contents (in wt. %):

| | |
|---|---|
| Cu | ≤0.08 |
| Ni | ≤0.08 |
| Nb | ≤0.005 |
| V | ≤0.01 |
| P | ≤0.01 |
| S | ≤0.003 |
| N | 0.003-0.005 |
| Sn | ≤0.015 |
| Zr | ≤0.006 |
| As | ≤0.012 |

-continued

| | |
|---|---|
| Ca | ≤0.005 |
| H | ≤0.0003 |
| O | ≤0.0020 |

b) a multiphase microstructure comprising (in vol. %):

| | |
|---|---|
| bainitic ferrite | ≥50 |
| tempered martensite | ≤30 |
| fresh martensite | ≤20 |
| retained austenite | 2-20 |
| polygonal ferrite | ≤10 |

c) at least one of the following mechanical properties

| | | |
|---|---|---|
| tensile strength ($R_m$) | 1100-1350 | MPa |
| yield strength ($R_{p0.2}$) | 780-1100 | MPa |
| total elongation ($A_{50}$) | ≥7 | % |
| hole expansion ratio (λ) | ≥20 | % |
| yield ratio ($R_{p0.2}/R_m$) | ≥0.50 | |

The yield ratio is preferably ≥0.70 or even ≥0.75.

The cold rolled steel sheet according to the invention may fulfill all requirements of claims 1, 3 and 4 or, preferably all requirements of claims 1, 3, 4 and 5.

The cold rolled steel may fulfilling at least one of the following requirements:

a) a composition fulfilling at least one of the following requirements (in wt. %):

| | |
|---|---|
| C | 0.16-0.24 |
| Si | 0.7-1.6 |
| Cr | ≤0.5 |
| Al | 0.01-1.0 |
| Mn | 1.8-2.5 |

c) the following mechanical properties

| | | |
|---|---|---|
| a tensile strength ($R_m$) | ≥1120 | MPa |
| total elongation ($A_{50}$) | ≥10 | % |
| hole expansion ratio (λ) | ≥20 | %. |

The cold rolled steel sheet may also fulfil the following requirements:

a) a composition fulfilling at least one of the following requirements (in wt. %):

| | |
|---|---|
| C | 0.16-0.24 |
| Si | 0.8-1.6 |
| Cr | ≤0.4 |
| Al | 0.03-0.1 |
| Mn | 1.8-2.5 |

c) the following mechanical properties

| | | |
|---|---|---|
| a tensile strength ($R_m$) | ≥1120 | MPa |
| total elongation ($A_{50}$) | ≥10 | % |
| hole expansion ratio (λ) | ≥20 | %. |

Example 1

A steel having the following composition was produced by conventional metallurgy by converter melting and secondary metallurgy:

| | |
|---|---|
| C | 0.22 |
| Si | 1.5 |
| Mn | 2.5 |
| Cr | 0.1 |
| Al | 0.044 |
| Ti | 0.03 |
| B | 0.0025 |
| Cu | 0.03 |
| Ni | 0.01 |
| P | 0.01 |
| S | 0.003 |
| N | 0.004 |

balance Fe and impurities.

The steel was continuously cast and cut into slabs. The slabs were reheated and subjected to hot rolling to a thickness of about 2.8 mm. The hot rolling finishing temperature was about 900° C. and the coiling temperature about 550° C. The hot rolled strips were pickled and batch annealed in a bell furnace at about 580° C. for a time of 10 hours in order to reduce the tensile strength of the hot rolled strip and thereby reducing the cold rolling forces. The strips were thereafter cold rolled in a five stand cold rolling mill to a final thickness of about 1.35 mm and finally subjected to continuous annealing in a Continuous Annealing Line (CAL).

The annealing cycle consisted of heating to a temperature of about 850° C., soaking for about 120 s, cooling during 30 seconds to an overaging temperature of about 405° C., isothermal holding at the overaging temperature for about 3 minutes and final cooling to the ambient temperature. The strip thus obtained free from FM, had a matrix of BF and contained 7% RA. The tensile strength ($R_m$) was 1220 MPa, the yield strength ($R_{p0.2}$) was 948 MPa, the total elongation ($A_{50}$) was 12% and the hole expansion ratio (λ) was 34%.

The $R_m$ and $R_{p0.2}$ values are derived according to the European norm EN 10002 Part 1, wherein the samples were taken in the longitudinal direction of the strip. The total elongation ($A_{50}$) is derived in accordance with the Japanese Industrial Standard JIS Z 2241: 2011, wherein the samples are taken in the transversal direction of the strip.

The hole expanding ratio (λ) is the mean value of three samples subjected to hole expansion tests (HET). It was determined by the hole expanding test method according to ISO/TS16630:2009 (E). In this test a conical punch having an apex of 60° is forced into a 10 mm diameter punched hole made in a steel sheet having the size of 100×100 mm$^2$. The test is stopped as soon as the first crack is determined and the hole diameter is measured in two directions orthogonal to each other. The arithmetic mean value is used for the calculation.

The hole expanding ratio (λ) in % is calculated as follows:

$$\lambda=(Dh-Do)/Do\times 100$$

wherein Do is the diameter of the hole at the beginning (10 mm) and Dh is the diameter of the hole after the test.

Example 2

A steel having the following composition was produced by conventional metallurgy by converter melting and secondary metallurgy:

| | |
|---|---|
| C | 0.21 |
| Si | 0.81 |
| Mn | 2.5 |
| Cr | 0.31 |
| Al | 0.046 |
| Ti | 0.03 |
| B | 0.0032 |
| Cu | 0.013 |
| Ni | 0.011 |
| P | 0.009 |
| S | 0.002 |
| N | 0.004 |

balance Fe and impurities.

The steel was continuously cast and cut into slabs. The slabs were reheated and subjected to hot rolling to a thickness of about 2.8 mm. The hot rolling finishing temperature was about 900° C. and the coiling temperature about 550° C. The hot rolled strips were pickled and batch annealed in a bell furnace at about 580° C. for a time of 10 hours in order to reduce the tensile strength of the hot rolled strip and thereby reducing the cold rolling forces. The strips were thereafter cold rolled in a five stand cold rolling mill to a final thickness of about 1.35 mm and finally subjected to continuous annealing in a Continuous Annealing Line (CAL).

The annealing cycle consisted of heating to a temperature of about 840° C., soaking for about 120 s, cooling during 30 seconds to an overaging temperature of about 375° C., isothermal holding at the overaging temperature for about 3 minutes and final cooling to the ambient temperature. The strip thus obtained had a matrix of BF and contained 13% RA and 15% FM. The tensile strength ($R_m$) was 1289 MPa, the yield strength ($R_{p0.2}$) was 877 MPa, the elongation ($A_{50}$) was 10% and the hole expansion ratio (λ) was 27%.

The material of the present invention can be widely applied to high strength structural parts in automobiles. The high ductility high strength cold rolled steel sheets are particularly well suited for the production of parts having high demands on the total elongation.

The invention claimed is:

1. A cold rolled steel sheet having:

a) a composition consisting of, in wt. %:

| | |
|---|---|
| C | 0.15-0.25 |
| Si | 1.5-1.6 |
| Mn | 2.2-2.8 |
| Cr | ≤0.8 |
| Mo | ≤0.2 |
| Al | 0.03-1.0 |
| Nb | ≤0.04 |
| V | ≤0.04 |
| Ti | 0.02-0.04 |
| B | 0.001-0.005 |
| Ti/B | 8-11 |

balance Fe apart from impurities, wherein the impurity contents of Cu and Ni are limited to

| | |
|---|---|
| Cu | ≤0.15 |
| Ni | ≤0.15; |

b) a multiphase microstructure comprising a matrix of bainitic ferrite and wherein the amount of polygonal ferrite is ≤10 vol. %, and c) the following mechanical properties

| | |
|---|---|
| a tensile strength ($R_m$) | 980-1500 MPa |
| yield strength ($R_{p0.2}$) | 580-1200 MPa |
| total elongation ($A_{50}$) | ≥3%. |

2. The cold rolled steel sheet according to claim 1, wherein the cold rolled sheet contains 0.01-0.8 wt. % Cr.

3. The cold rolled steel sheet according to claim 1, wherein the cold rolled steel is provided with a Zn containing layer.

4. The cold rolled steel sheet according to claim 1, wherein the steel composition fulfils at least one of the of the following requirements with respect to the impurity contents, in wt. %:

| | |
|---|---|
| Cu | ≤0.10 |
| Ni | ≤0.10 |
| P | ≤0.02 |
| S | ≤0.005 |
| N | 0.002-0.006. |

5. The cold rolled steel sheet according to claim 1, having:

a) a composition fulfilling at least one of the following requirements with respect to the impurity contents, in wt 0%:

| | |
|---|---|
| Cu | ≤0.08 |
| Ni | ≤0.08 |
| Nb | ≤0.005 |
| V | ≤0.01 |
| P | ≤0.01 |
| S | ≤0.003 |
| N | 0.003-0.005 |
| Sn | ≤0.015 |
| Zr | ≤0.006 |
| As | ≤0.012 |
| Ca | ≤0.005 |
| H | ≤0.0003 |
| O | ≤0.0020; |

b) a multiphase microstructure comprising, in vol. %:

| | |
|---|---|
| bainitic ferrite | ≥50 |
| tempered martensite | ≤30 |
| fresh martensite | ≤20 |
| retained austenite | 2-20 |
| polygonal ferrite | ≤10; and |

c) at least one of the following mechanical properties

| | |
|---|---|
| tensile strength ($R_m$) | 1100-1350 MPa |
| yield strength ($R_{p0.2}$) | 780-1100 MPa |
| total elongation ($A_{50}$) | ≥7% |
| hole expansion ratio (λ) | ≥20% |
| yield ratio ($Rp_{0.2}/R_m$) | ≥0.50. |

6. The cold rolled steel sheet according to claim 1, fulfilling at least one of the following requirements:

a) a composition fulfilling at least one of the following requirements, in wt. %:

| | |
|---|---|
| C | 0.16-0.24 |
| Si | 0.6-1.5 |

-continued

| | |
|---|---|
| Cr | 0.03-0.5 |
| Al | 0.03-1.0 |
| Mn | 2.2-2.5; and |

b) the following mechanical properties

| | |
|---|---|
| a tensile strength ($R_m$) | 1020-1500 MPa |
| total elongation ($A_{50}$) | ≥10% |
| hole expansion ratio (λ) | ≥20%. |

7. The cold rolled steel sheet according to claim 1, fulfilling the following requirements:

a) a composition fulfilling at least one of the following requirements, in wt. %:

| | |
|---|---|
| C | 0.16-0.24 |
| Si | 1.2-1.4 |
| Cr | 0.05-0.5 |
| Al | 0.04-1.0 |
| Mn | 2.2-2.5; and |

b) the following mechanical properties

| | |
|---|---|
| a tensile strength ($R_m$) | 1020-1500 MPa |
| total elongation ($A_{50}$) | ≥10% |
| hole expansion ratio (λ) | ≥20%. |

* * * * *